United States Patent [19]

D'Luhy

[11] 4,138,302

[45] * Feb. 6, 1979

[54] METHOD OF MAKING A STUBLESS MULTI-PLY ASSEMBLY

[75] Inventor: Emil A. D'Luhy, Youngstown, N.Y.

[73] Assignee: Moore Business Forms, Inc., Niagara Falls, N.Y.

[ * ] Notice: The portion of the term of this patent subsequent to Aug. 2, 1994, has been disclaimed.

[21] Appl. No.: 809,056

[22] Filed: Jun. 22, 1977

Related U.S. Application Data

[63] Continuation of Ser. No. 623,393, Oct. 17, 1975, Pat. No. 4,039,046.

[51] Int. Cl.[2] ..... B31F 1/00

[52] U.S. Cl. ..... 156/216; 156/223; 156/226

[58] Field of Search ..... 156/216, 226, 227, 222, 156/223; 282/22 R, 22 A, 23 A, 23 R, 24 A, 24 B, 24 C, 24 R, 11.5 A, 11.5 R

[56] References Cited

U.S. PATENT DOCUMENTS

| | | | |
|---|---|---|---|
| 1,949,625 | 3/1934 | Ritzhaupt | 282/22 R |
| 2,005,930 | 6/1935 | Bovier | 282/22 R |
| 2,006,034 | 6/1935 | Stevens | 282/22 R |
| 4,039,046 | 8/1977 | D'Luhy | 282/22 R |

*Primary Examiner*—John T. Goolkasian
*Assistant Examiner*—William H. Thrower
*Attorney, Agent, or Firm*—Watson, Cole, Grindle & Watson

[57] ABSTRACT

A stubless unit set of multiple plies of the type including at least superimposed top, intermediate and bottom plies is made by removably interconnecting the top and bottom plies together and by removably interconnecting the intermediate and bottom plies together. The top and bottom plies are interconnected by providing a fold flap along an edge of the top ply, applying detachable adhesive to the flap, folding the flap to underlie the bottom ply and contacting the bottom ply with the adhesive, and the intermediate and bottom plies are interconnected by providing at least one hole in the bottom ply and extending a portion of the adhesive through the hole so as to contact the intermediate ply. Each of the plies is devoid of any tear lines which may form a stub.

4 Claims, 3 Drawing Figures

2
15
15
18
18
15
18
17
10
18
19
16
14
11
12
13
2

10

11
12
13
14
22
16a
15
18
16
17

22
17
16
11
12
15
13
18
19
14
10

METHOD OF MAKING A STUBLESS MULTI-PLY ASSEMBLY

RELATED APPLICATION

This application is a Continuation of U.S. Ser. No. 623,393, filed Oct. 17, 1975, and co-pending herewith, now U.S. Pat. No. 4,039,046 was granted Aug. 2, 1977 on such application.

BACKGROUND OF THE INVENTION

This invention relates generally to the making of a stubless multi-ply assembly, and more particularly to the making of such an assembly of the type which includes superimposed top, intermediate and bottom plies with the top and bottom plies removably interconnected, and the intermediate and bottom plies removably interconnected.

Business forms arranged as interconnected unitary sets of multiple sheets or plies are available in various forms constructions and adapted for inscription either manually or with the use of a typewriter. The most common of these unit sets is one having a removable stub portion for interconnecting the sheets of the set together. The sheets may therefore be separated as the stub is removed, or individual sheets may be removed from the stub while leaving the remaining sheets of the set intact. Typically, such a set comprises a top record ply which is removed from the set for record keeping while the balance of the plies remain intact after which they are subsequently separated. This stub however represents a completely unusable portion of the form since it is ultimately discarded after removal. Any writing or printing on the form sheets must therefore be confined to areas outside the stub thereby resulting either in the need for larger sheets or a smaller printing and writing area. Hence, this wasteful stub accounts for a poor economical use of the set. Moreover, the sheets of the assembly are normally interconnected at the stub by glue lines axially aligned between the top and bottom sheets thereby adding to the thickness or bulk of the assembly.

U.S. Pat. No. 1,949,625 to Ritzhaupt discloses a forms construction which minimizes the thickness of the assembly at the forward end by means of attaching the sheets together by a single line of adhesive passing through axially aligned apertures provided in several of the sheets. However, a removable stub is nevertheless required for such assembly since it is so constructed that the sheets cannot be removed unless separated along the stub. All the drawbacks noted for the typical forms construction requiring a removable stub are therefore common to this prior art construction.

SUMMARY AND OBJECTS OF THE INVENTION

It is therefore an object of the present invention to provide a multi-ply unit set as having no stub portion yet thereby avoiding the noted disadvantages of an assembly requiring such stub while at the same time retaining the advantages of a stub.

Another object of the invention is to provide such a unit set of a stubless construction which is not only highly economical in its use since it avoids stub handling and disposal and permits a more effective use of the plies themselves, but is also simple in its construction and easy to manufacture.

In carrying out these objectives the multi-ply set of the invention is made of the type including at least superimposed top, intermediate and bottom plies. The top ply is removably attached to a flap underlying the bottom ply and having adhesive provided thereon. Holes are provided in the bottom ply through which the adhesive on the flap extends so as to adhesively secure the intermediate and bottom plies together. Various modes of ply separation are therefore made possible. For example, the top ply may be removed while leaving the intermediate and bottom plies intact, or the intermediate ply may be removed while leaving the top and bottom plies interconnected, or the top and intermediate plies may be removed so as to separate all the plies.

A unit set may also be made according to the invention of the type which includes superimposed top, first and second intermediate, and bottom plies. Holes are provided in the bottom ply axially aligned with holes provided in the second intermediate ply but of a size less than such intermediate ply holes. The adhesive on the flap therefore extends through these aligned holes so as to engage the edges of the bottom ply holes. The difference in hole size defines portions of the bottom ply which serve to mask the second intermediate ply holes and therefore confine the adhesive extending therethrough to a size equal to that of the bottom ply holes. The adhesive extending through the second intermediate ply holes are therefore spaced inwardly of the hole margins thereof, and ply separation is effected similarly as described for the three-ply set.

DETAILED DESCRIPTION OF THE INVENTION

Figure 1:
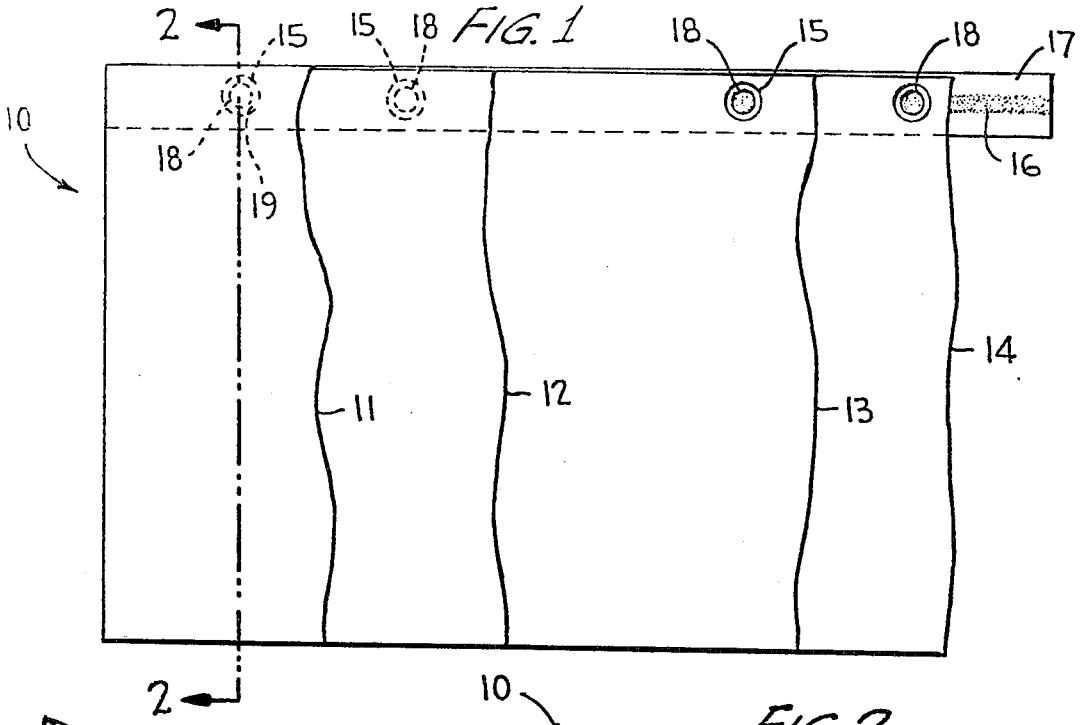
FIG. 1 is a top plan view of the multi-ply set according to the invention, several of the plies being broken away for clarity.

The unit set or assembly of multiple plies in accordance with the invention is generally designated 10 in the drawings and is made into such set of the type which includes at least superimposed top, intermediate and bottom plies 11, 12 and 14 so as to form a three-ply set. It will be seen that an additional intermediate ply 13 may be used to form a four-ply stubless set, intermediate plies 12 and 13 therefore being hereinafter referred to as first and second intermediate plies, respectively, when describing the four-ply stubless set shown in the drawings.

Figure 2:
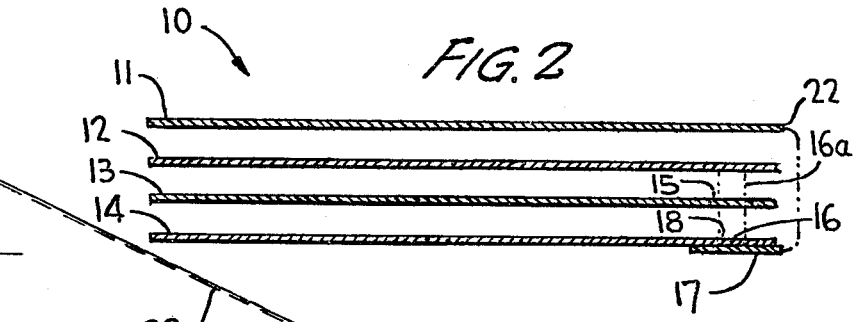
FIG. 2 is a cross-sectional view of the set taken substantially along line 2–2 of FIG. 1.
Figure 3:
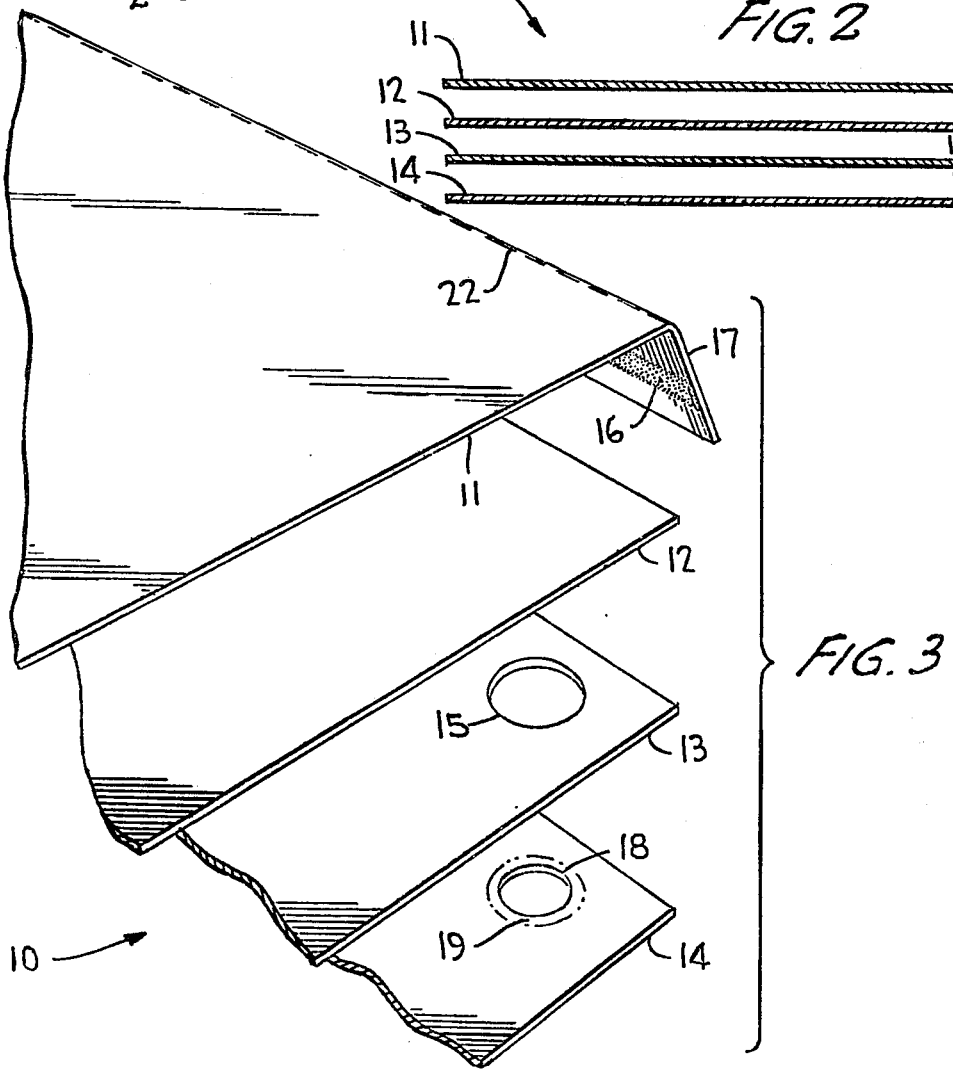
FIG. 3 is an expanded view of a portion of the multi-ply set, slightly enlarged, showing the details of the invention.

Holes 15 are provided along a marginal edge of second intermediate ply 13, and a quantity of detachable adhesive 16 is provided on an undersurface of flap 17 of the top ply, which flap 17 underlies bottom ply 14 as shown in FIG. 2. Holes 18 are provided in the bottom ply respectively in axial alignment with holes 15. Adhesive 16 may be applied to flap 17 along a line as shown in FIG. 1, or dots of adhesive slightly greater than the size of holes 18 may be applied along the flap to coincide with such holes. Portions **16*a* of adhesive 16 extend between ply 12 and flap 17, and these portions 16*a* extend through aligned openings 15 and 18 as shown in FIG. 2. Such adhesive portions therefore secure first intermediate ply 12 to the bottom ply as portions 16*a* completely fill holes 18 in the bottom ply. However, the difference in sizes between holes 15 and 18 define portions 19 of the bottom ply which serve to mask a part of holes 15. Accordingly, the size of portions 16***a* of adhesive extending through openings 15 of second intermediate ply 13 are confined to the size of holes 18 in the bottom ply. And, since the holes in second intermediate ply 13 and in the bottom ply are axially aligned, portions 16*a* of adhesive extending through holes 15 are located inwardly of the marginal edges of these holes as shown in FIG. 2. Hence, no direct or positive adhesive securement is effected between the adhesive and ply 13. It is therefore seen that separation of the first intermediate and bottom plies will effect a break of adhesive portions 16*a* thereby freeing second intermediate ply 13 from the set.

Top ply 11 overlies first intermediate ply 12 and is removably attached to flap 17 along a line 22 of weakening. Flap 17 extends about the aligned marginal edges of plies 12, 13 and 14 as shown in exaggerated form in FIG. 2.

Each of the plies of the set according to the invention is devoid of any tear lines which may form a stub so that indicia is capable of being applied to a larger area of each ply within the margins thereof as compared to a unit set having a stub. As is apparent from the drawings, the unit set is made of four superimposed plies, or of three superimposed plies by eliminating second intermediate ply 13. In the four-ply set, top and bottom plies 11 and 14 are removably interconnected by the provision of a fold flap 17 along an edge coinciding with line 22 of the top ply, such flap having applied thereto a quantity of detachable adhesive on an inner surface thereof, the flap being folded to underlie the bottom ply with the adhesive contacting the outer surface of the bottom ply as shown in FIG. 2. The first intermediate and bottom plies 12 and 14 are likewise removably interconnected by the provision of at least one hole 18 in the bottom ply and by extending a portion 16*a* of the adhesive through this hole so as to contact first intermediate ply 12. And, for the four-ply set, second intermediate ply 13 is disposed between plies 12 and 14 and is provided with a hole 15 in axial alignment with hole 18 but of a slightly larger size. Such portion 16*a* of adhesive therefore extends through hole 15 but is spaced slightly inwardly of the marginal edge thereof.

In the three-ply construction which eliminates the use of second intermediate ply 13, it can be seen that separation of top ply 11 from the set leaves plies 12 and 14 intact, while removal of ply 12 from the set leaves plies 11 and 14 interconnected. Also, removal of plies 11 and 12 separates all the plies of the set from one another. Such is likewise true for the four-ply unit set in that plies 12 and 13 may be removed while leaving plies 11 and 14 interconnected, or ply 11 may be removed while leaving plies 12, 13 and 14 intact, or removal of plies 11 and 12 separates all the plies of the set from one another.

In order to transfer indicia through the set after being applied to top ply 11, sheets of carbon transfer material may be provided between adjacent plies, or some type of known carbonless transfer composition or a mixture of carbon transfer and carbonless transfer materials may be coated on mating surfaces of the plies.

In addition to those advantages mentioned above concerning the greater areas on each ply made available for applying information, the stubless form in accordance with the invention avoids the need for handling any stub or further disposing of same. Stub waste is therefore avoided and greater economical use is made available for the form.

Obviously, many other modifications and variations of the invention are made possible in the light of the above teachings. For example, additional intermediate plies 13, for making a five-, six-, seven-, etc.-ply set, may be utilized for the unit set without departing from the scope of the present invention. It is therefore to be understood that within the scope of the appended claims the invention may be practiced otherwise than as specifically described.

What is claimed is:

1. A method of making a stubless unit set of multiple plies of the type which includes superimposed top, intermediate and bottom plies, comprising, providing a fold flap along one edge of said top ply, applying a line of weakening extending along the fold between said flap and said top ply to thereby render said flap removably connected to said top ply, applying a quantity of detachable adhesive to one surface of said flap, providing at least one hole in only said bottom ply along an edge thereof underlying said one edge, folding said flap along said line of weakening and about a edge of said intermediate ply underlying said one edge and further about said edge of said bottom ply, bringing said one surface of said flap into contact with an undersurface of said bottom ply so that said adhesive secures said top and bottom plies together, extending a portion of said adhesive through said hole and against an undersurface of said intermediate ply to thereby interconnect said intermediate and bottom plies together, and maintaining each of said plies free of any tear lines which may form a stub, whereby removal of said top ply along said line of weakening leaves said intermediate and bottom plies intact, or removal of said intermediate ply leaves said top and bottom plies interconnected, or removal of said top and intermediate plies separates each of said plies from one another.

2. The method according to claim 1, wherein said quantity of adhesive is applied to said one surface of said flap along a line parallel to said line of weakening.

3. A method of making a stubless unit set of multiple plies of the type which includes superimposed top, intermediate and bottom plies, comprising, removably interconnecting said top and bottom plies together, and removably interconnecting said intermediate and bottom plies together, said top and bottom plies being interconnected by providing a fold flap along an edge of said top ply, applying detachable adhesive on an inner surface of said flap, folding said flap to underlie said bottom ply and contacting said bottom ply with said adhesive, said intermediate and bottom plies being interconnected by providing at least one hole in only said bottom ply and extending a portion of said adhesive through said hole so as to contact said intermediate ply, and maintaining each of said plies free of any tear lines which may form a stub, whereby removal of said top ply along said line of weakening leaves said intermediate and bottom plies intact, or removal of said intermediate ply leaves said top and bottom plies interconnected, or removal of said top and intermediate plies separates each of said plies from one another.

4. The method according to claim 3, wherein said quantity of adhesive is applied to said inner surface of said flap along a line parallel to an edge of said top ply.

* * * * *